US007794244B2

(12) United States Patent
Mao et al.

(10) Patent No.: US 7,794,244 B2
(45) Date of Patent: Sep. 14, 2010

(54) ELECTRICAL CONNECTOR HAVING GROUNDING BRIDGE

(75) Inventors: Yu-Hua Mao, Kunshan (CN); Zhi-Hong Fang, Kunshan (CN); Xue-Qing Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/381,053

(22) Filed: Mar. 5, 2009

(65) Prior Publication Data

US 2009/0227129 A1 Sep. 10, 2009

(30) Foreign Application Priority Data

Mar. 5, 2008 (CN) ..... 2008 2 0032483 U

(51) Int. Cl.
*H01R 4/66* (2006.01)

(52) U.S. Cl. ..... 439/108; 439/607.58

(58) Field of Classification Search ..... 439/607.04, 439/607.14, 607.31, 607.33, 108, 947
See application file for complete search history.

(56) References Cited

U.S. PATENT DOCUMENTS 4,171,861 A * 10/1979 Hohorst ..... 439/94
5,669,788 A * 9/1997 Brockman ..... 439/511
6,159,049 A * 12/2000 Schramme et al. ..... 439/620.21
6,390,833 B1 * 5/2002 Chang ..... 439/108
6,488,514 B2 * 12/2002 Kubo et al. ..... 439/108
6,663,402 B1 * 12/2003 Yu ..... 439/108
6,672,887 B1 * 1/2004 Yu ..... 439/108
6,755,690 B1 * 6/2004 Zhang ..... 439/607.02
7,311,543 B2 * 12/2007 Hanning et al. ..... 439/268

* cited by examiner

*Primary Examiner*—Michael C Zarroli
(74) *Attorney, Agent, or Firm*—Andrew C. Cheng; Wei Te Chung; Ming Chieh Chang

(57) ABSTRACT

An electrical connector includes an insulative housing (1) which comprise a pair of side walls (121) and a pair of end walls (122) linking with two ends of the side wall, a plurality of terminals (2) retained in the side wall and a pair of grounding bridges (3) received in the end wall. Each of the grounding bridge comprise a contacting part (31) engaging with a mating connector, a grounding part (32) and a conducting part (33) mechanically connecting with the contacting part and grounding part. And the conductive part (33) has a larger resistance compared with the contacting part and the grounding part. Therefore, the power current transmitting through the guiding bridge (3) can be lower.

10 Claims, 5 Drawing Sheets

ELECTRICAL CONNECTOR HAVING GROUNDING BRIDGE

BACKGROUND OF THE INVENTION

1. Field of the Invention

The present invention relates to an electrical connector, especially to an electrical connector with grounding bridge.

2. Description of the Related Art

U.S. Pat. No. 6,663,402 issued on Dec. 16, 2003, discloses an electrical connector including an insulative housing, a plurality of terminals retained in the insulative housing, a pair of grounding bridges attached at the guiding columns at two ends of the insulative housing, and a metallic shell covers an outside of the insulative housing. Each of the guiding bridges has a body portion mechanically and electrically connecting with the metallic shell for discharging the static electricity of the mating connector by grounding, an elastic arm extending upwardly from the body portion. The elastic arm is closer to the mating connector than the terminals for earlier engaging with the mating connector electrically.

However, the grounding bridge is made of a metallic plate such as familiar iron, copper sheet, etc. When the electrical connector and the mating connector engage with each other, the static power current of the mating connector transmitting is likely over the endurable limit of the electrical connector when the resistance of the grounding bridge is not enough big, so it could damage the electrical connector system.

Therefore, an improved electrical connector is desired to overcome the disadvantages of the related arts.

SUMMARY OF THE INVENTION

An object of the present invention is to provide an electrical connector with grounding bridge for discharging static thereof.

In order to achieve above-mentioned object, an electrical connector in accordance with a preferred embodiment of the present invention includes an electrical connector includes an insulative housing which comprise a pair of side walls and a pair of end walls linking with two ends of the side wall, a plurality of terminals retained in the side wall and a pair of grounding bridges received in the end wall. Each of the grounding bridge comprise a contacting part engaging with a mating connector, a grounding part and a conducting part mechanically connecting with the contacting part and grounding part. And the conductive part has a larger resistance compared with the contacting part and the grounding part. Therefore, the power current transmitting through the guiding bridge can be lower.

Other objects, advantages and novel features of the invention will become more apparent from the following detailed description of the present embodiment when taken in conjunction with the accompanying drawings.

DETAILED DESCRIPTION OF THE INVENTION

Figure 1:
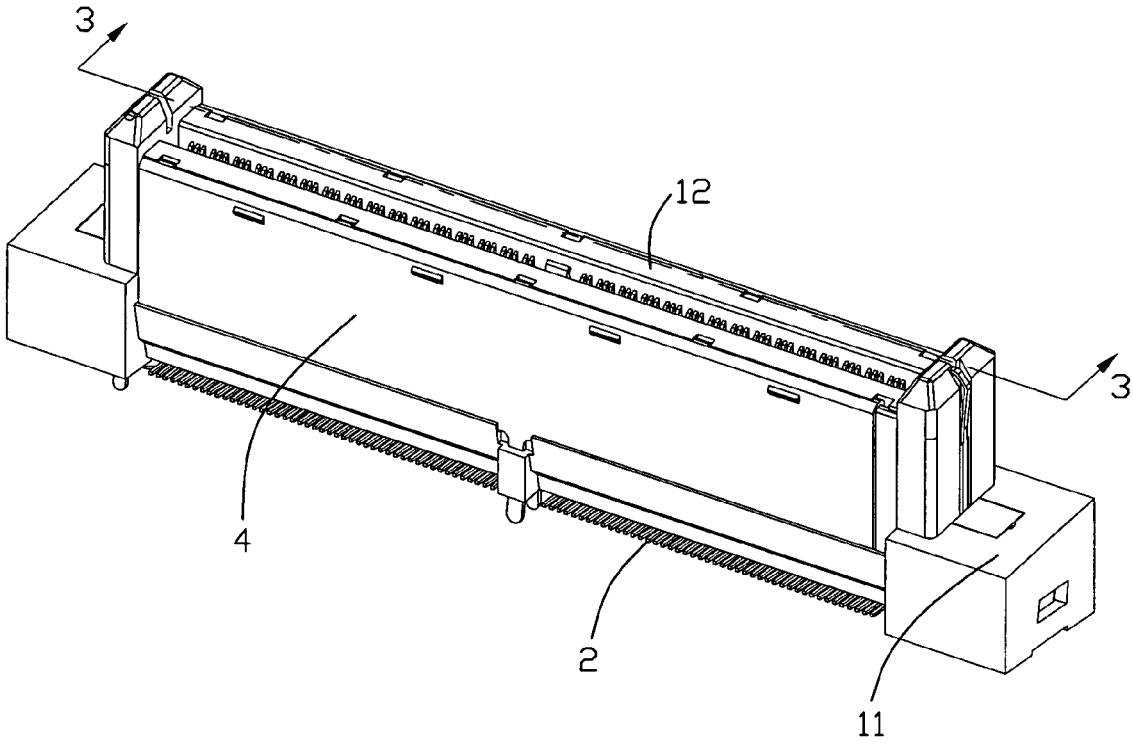
FIG. 1 is a perspective view of an electrical connector in accordance with the preferred embodiment of the present invention.

Reference will now be made to the drawing figures to describe the preferred embodiment of the present invention in detail.

Figure 2:
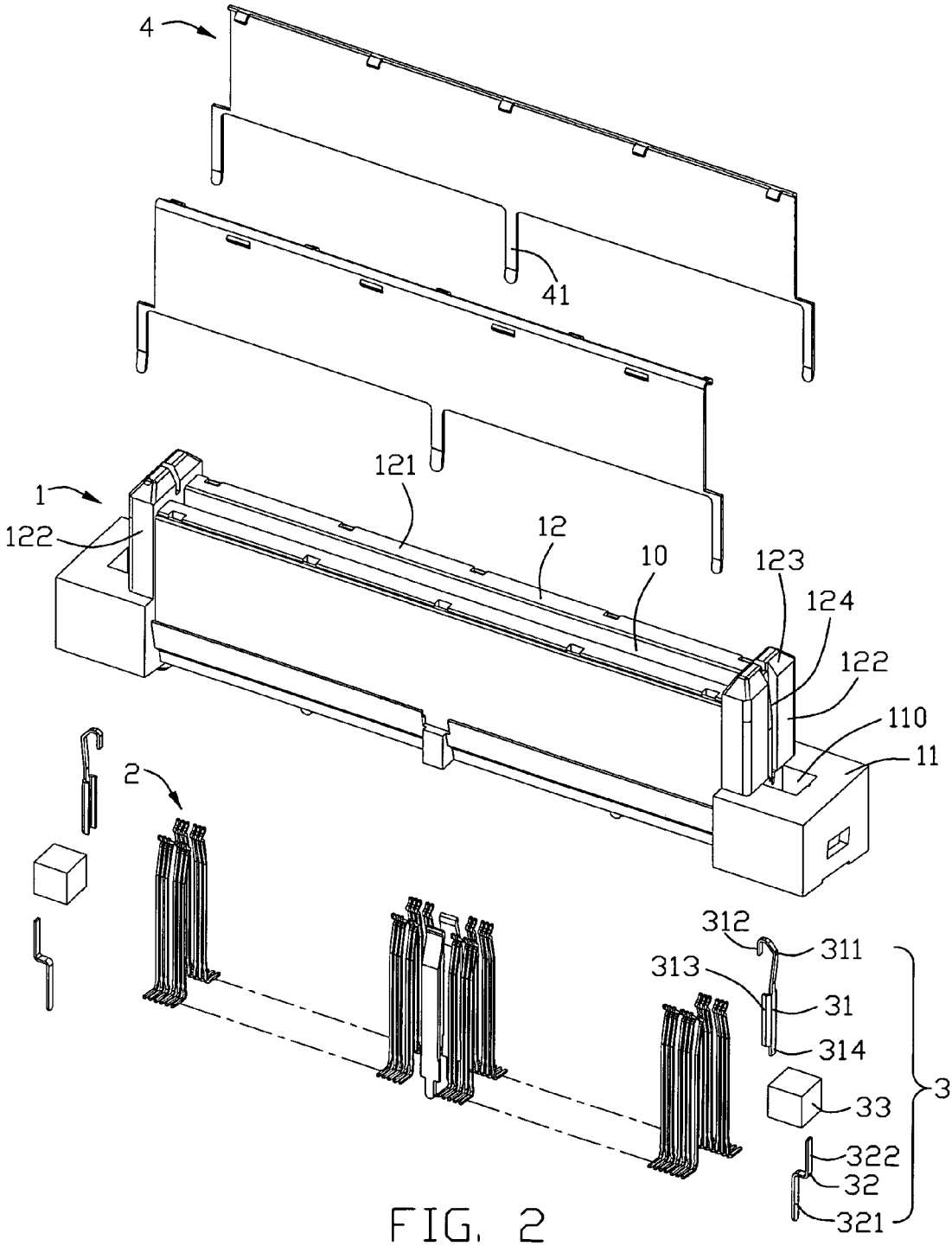
FIG. 2 is an exploded perspective view of the electrical connector of FIG. 1.
Figure 3:
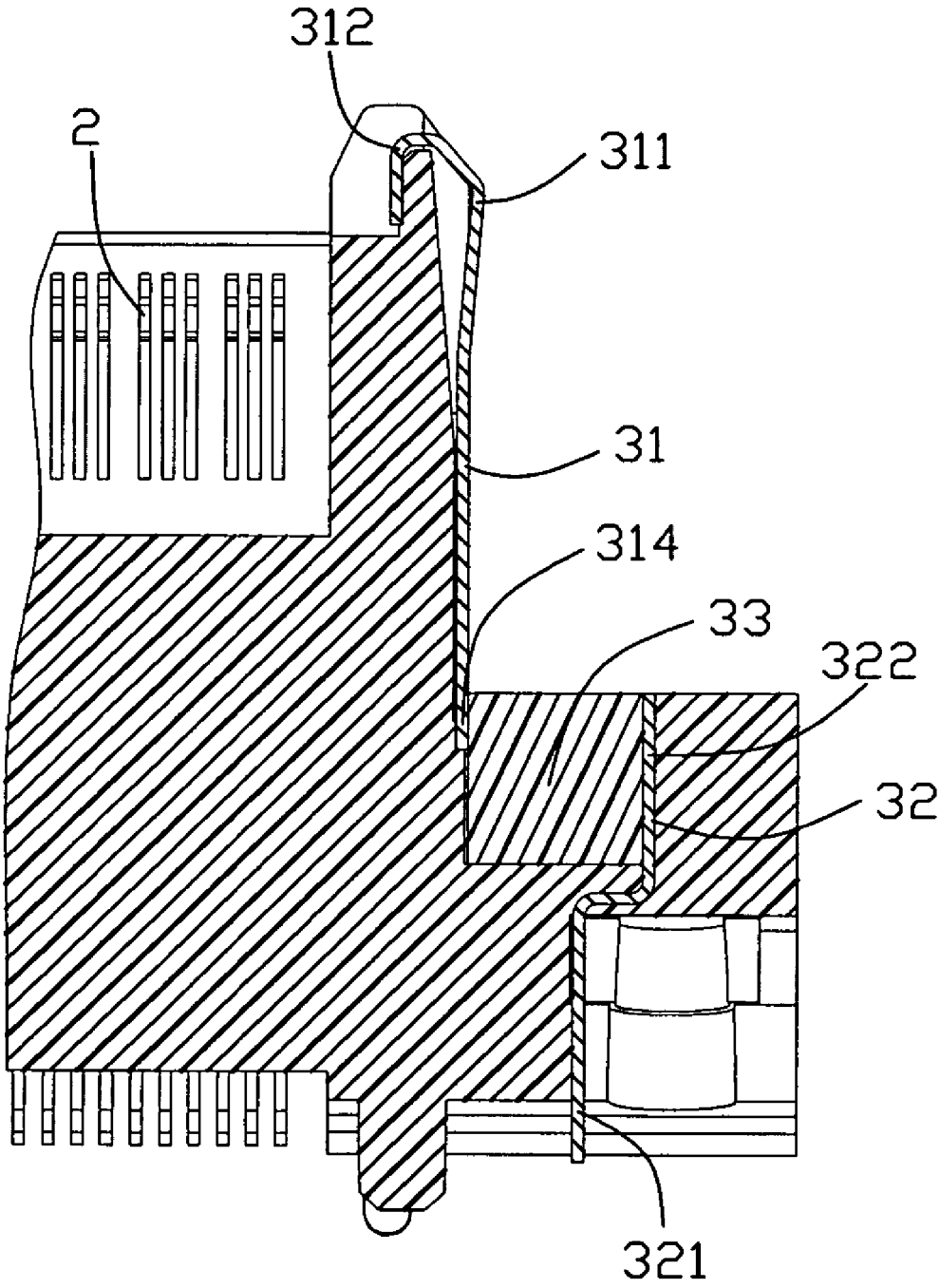
FIG. 3 is a partly cross-section view of the electrical connector taken along line 3-3 of FIG. 1.

Referring to FIG. 1 to FIG. 3, an electrical connector 100 in accordance with the present invention includes an insulative housing 1, a plurality of terminals 2 retained in the insulative housing, a pair of grounding bridges 3 received in the insulative housing, and a pair of metallic shells 4 covering the insulative housing.

The insulative housing 1 is provided with a base portion 11 and a mating portion 12 upwardly extending from the base portion for mating with the mating connector. The base portion 11 is mounted on a PCB (not shown). The mating portion 12 includes a pair of longitudinal side walls 121 and a pair of end walls 122 integrally linking with two ends of the side walls, thereby forming a mating room 10 for receiving the mating connector. The end wall 122 defines a guiding portion 123 at the tip thereof for guiding the connector to mate with the mating connector. Each of the side walls 121 includes a plurality of passageways for retaining and receiving the terminals 2.

Each of the end walls defines a groove 124 extending along a mating direction and running through the outside face of guiding portion 123. The two ends of the base portion each defines a hole 110 communicating with the groove 124. The grounding bridge 3 includes three separately parts, a contacting part 31, a grounding part 32 and a conducting part 33. The contacting part 31 is received in the groove 124 and has retaining portion 313 bending inwardly and retained with the housing, a bottom end 314 protruding downward into the hole 110 and a contacting portion 311 extending to the top of the guiding portion 123 for firstly engaging with the mating connector. The contacting part 31 hooks the tip of the guiding portion 123 with a hooking portion 312 adjacent the contacting portion 311. The grounding parts 32 are embedded in the two ends of the base portions and each grounding part 32 includes a soldering portion 321 extending out of the housing to connect with a grounding trace of a PCB or the shell 4 and a touching portion 322 protruding into the hole 110. The conductive parts 33 of square shape are received in the hole 110 and each conductive part defines a pair of opposite contacting surfaces for contact with the bottom end 314 of the contacting part 31 and the touching portion 322 of the grounding part 32, thereby forming a ground trace electrically connecting with the grounding trace of a PCB.

The contacting part 31 and the grounding part 32 are made of conductive metal sheet, such as brass, nickel-copper, bronze, iron, stainless steel sheet and so on, while the conductive part 33 is made of such metal material, as electric plastic, electric foam and so on, with a larger resistance compared with the contacting part and the grounding part. Therefore, the power current transmitting through the guiding bridge 3 can be lower.

The metallic shells 4 cover on the side walls 121 for preventing the electrical connector from EMI (Electro Magnetic Interference) with a plurality of retaining tails 41 inserted in the insulative housing at the end thereof.

Figure 4:
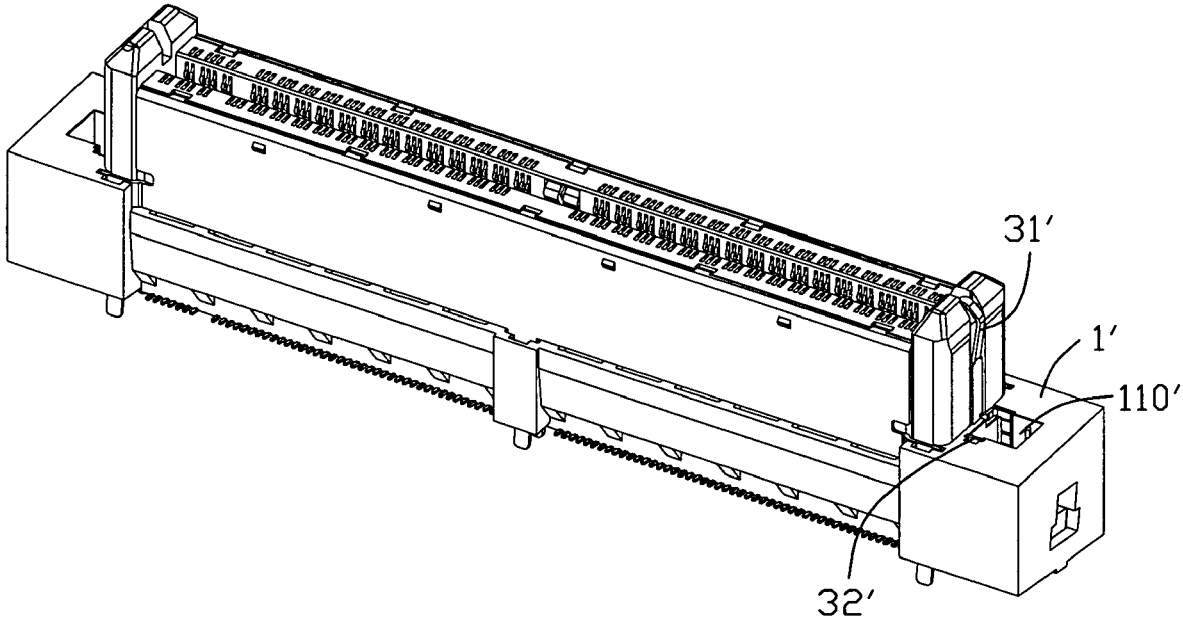
FIG. 4 is a perspective view of an electrical connector in accordance with the other embodiment of the present invention and without the conductive part thereof.
Figure 5:
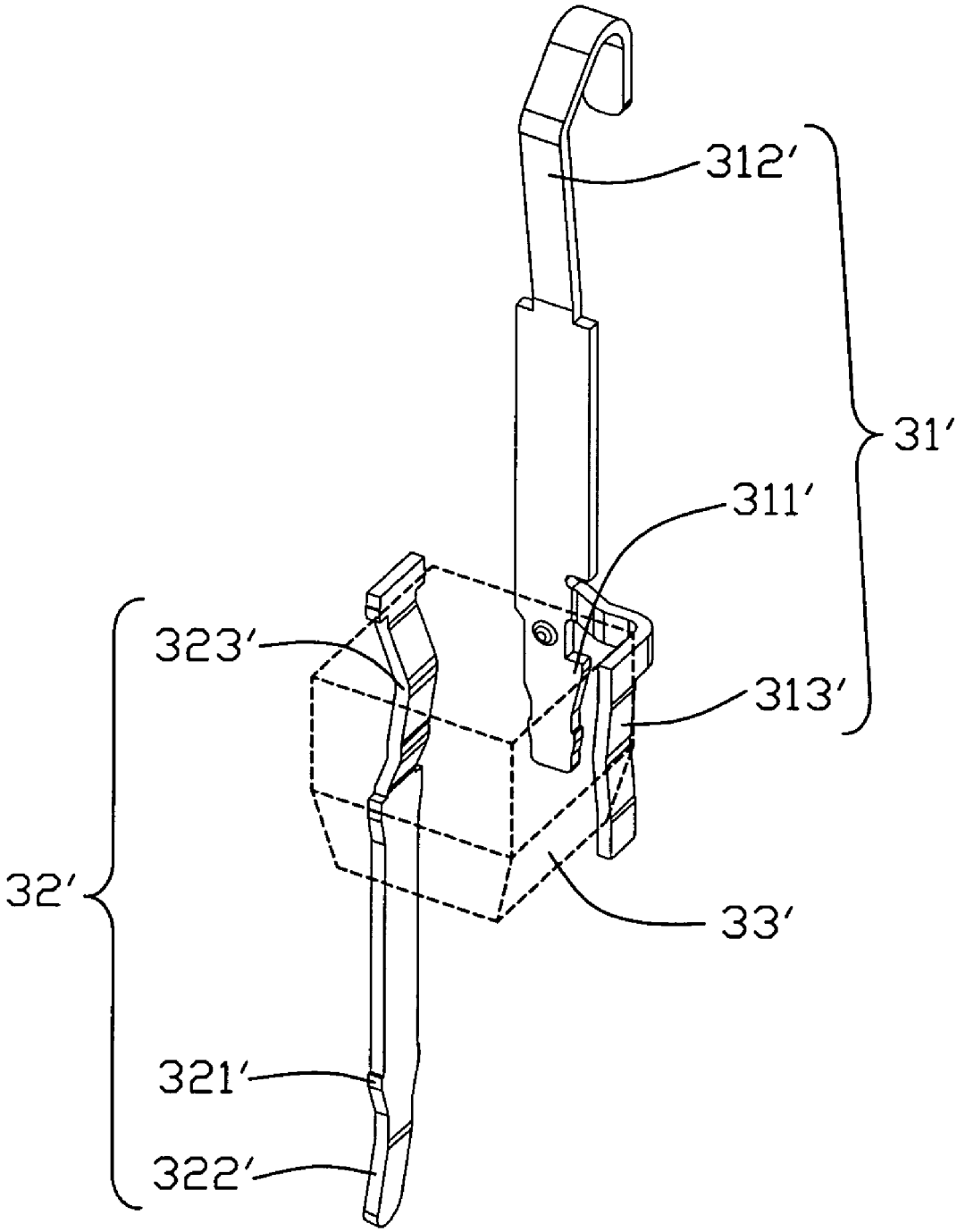
FIG. 5 is a sketch view of the grounding bridge of the electrical connector of FIG. 4.

Referring FIG. 4 and FIG. 5, an electrical connector of another embodiment of the present invention is shown, which is similar to that of aforementioned connector except a described grounding bridge 3'.

The contacting part 31' of the grounding bridge 3' is provided with a retaining portion 311' at the bottom end thereof for retained in the housing, a contacting portion 312' extending upwards to the top of the end wall from the retaining portion, a first touching portion 313' extending perpendicularly to the contacting portion and protruding into one side of the hole 110' for engaging with the conductive part 33'. The grounding part 32' includes a retaining portion 321' at the middle thereof retained in the housing, a soldering portion 322' extending out of the housing to connect with a grounding trace of a PCB or the shell and a second touching portion 323' extending upwards from the retaining portion 321' and protruding into another side opposite said one side of the hole 110'. The first touching portion 313' and the second touching portion 323' touch the conductive parts 33', thereby forming a ground trace electrically connecting with the grounding trace of a PCB. As the aforementioned connector, the contacting part 31' and the grounding part 32' has a larger resistance compared with the contacting part and the grounding part. Therefore, the power current transmitting through the guiding bridge 3' can be lower. The contacting part 31' and the grounding part 32' touching at opposite surface of the conductive part 33' benefit a better electrical performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing comprising a pair of side walls and a pair of end walls each linking with an end of each side wall;

a plurality of terminals retained in each side wall; and a pair of grounding bridges one of each received in an end wall, each of the grounding bridges comprising a contacting part for engaging with a mating connector, a grounding part adapted for mounting onto a printed circuit board, and a conducting part mechanically connecting with the contacting part and the grounding part;

wherein the conductive part has a larger resistance compared with the contacting part and the grounding part.

2. The electrical connector as described in claim 1, wherein each end wall comprises a groove running through an outside face of the end wall for receiving the contacting part.

3. The electrical connector as described in claim 2, wherein insulative housing comprises a pair of holes each in communication with corresponding groove at opposite ends thereof for receiving the conductive parts.

4. The electrical connector as described in claim 3, wherein the grounding part is embedded in the insulative housing and comprises a touching portion engaging with one side of the conductive part and a soldering portion projecting out of the insulative housing.

5. The electrical connector as described in claim 4, wherein the contacting part comprises a contacting portion abutting against the outside surface of each end wall, and a distal end engaging with another side of the conductive part opposite to the grounding part.

6. An electrical connector assembly for use between a complementary connector and a printed circuit board, comprising:

an insulative housing defining a mating port;

a plurality of terminals disposed in the housing with contacting sections exposed in the mating port and soldering sections for mounting to said printed circuit board; and a grounding bridge located at an end of the housing and having two ends respectively engaged with the complementary connector and the printed circuit board to create a grounding path therebetween; wherein said grounding bridge includes two sections having different resistance characteristics with each other and respectively acting as part of the grounding path, and the section of the larger resistance characteristics is spaced from and does not contact the complementary connector and said printed circuit board while the section of the smaller resistance characteristic directly contacts the complementary connector and the printed circuit board.

7. The electrical connector assembly as claimed in claim 6, wherein said two sections are discrete from each other while being in a surface contact manner.

8. The electrical connector assembly as claimed in claim 7, wherein the section having the larger resistance characteristic, defines a block configuration while the section of the smaller resistance characteristic defines a thin plate configuration.

9. The electrical connector assembly as claimed in claim 8, wherein the section having the larger resistance characteristic is made of electric plastic while the section having the smaller resistance characteristic is made of metallic.

10. An electrical connector assembly for use with a complementary connector, comprising:

an insulative housing defining a mating port;

a plurality of terminals disposed in the housing with contacting sections exposed in the mating port and soldering sections for mounting to a printed circuit board; and a grounding bridge located at an end of the housing and having two ends respectively engaged with the complementary connector and the printed circuit board to create a grounding path therebetween; wherein said grounding bridge includes two sections having different resistance characteristic with each other and respectively acting as part of the grounding path, of which the larger one belongs to the section which is spaced furthest from the complementary connector; wherein the section having the larger resistance characteristic is made of electric plastic while the section having the smaller resistance characteristic is made of metallic.

* * * * *